United States Patent [19]

Simmons

[11] Patent Number: 4,815,163

[45] Date of Patent: Mar. 28, 1989

[54] STORM DOOR LOCK APPARATUS

[76] Inventor: William O. Simmons, 116 Catherine St., Lyons, N.Y. 14489

[21] Appl. No.: 213,591

[22] Filed: Jun. 30, 1988

[51] Int. Cl.[4] ..... E05F 5/02; E05F 3/02

[52] U.S. Cl. ..... 16/49; 16/66; 16/82; 16/84; 16/DIG. 10; 16/DIG. 17

[58] Field of Search ..... 16/49, 51, 58, 66, 82, 16/84, DIG. 9, DIG. 10, DIG. 17

[56] References Cited

U.S. PATENT DOCUMENTS

| | | | |
|---|---|---|---|
| 2,920,338 | 1/1960 | Falk | 16/66 |
| 3,105,264 | 10/1963 | Truhon | 16/49 |
| 3,566,435 | 3/1971 | Nakamura | 16/85 |
| 3,708,825 | 1/1973 | Wood | 16/49 |
| 4,194,264 | 3/1980 | Stoffregen | 16/52 |
| 4,639,969 | 2/1987 | Obenshain | 16/70 |

*Primary Examiner*—Nicholas P. Godici
*Assistant Examiner*—Edward A. Brown
*Attorney, Agent, or Firm*—Leon Gilden

[57] ABSTRACT

A storm door lock apparatus is set forth wherein a clamp is secured to an associated screen-door type closure member that further secures a slidable rod mounted with an abutment surface for actuation by a user with a pivoted lever at the other end of said rod for canting about a piston rod associated with a door closure. Additionally, a generally "L" shaped link is securable to the abutment member for allowing engagement and access by a user.

7 Claims, 1 Drawing Sheet

STORM DOOR LOCK APPARATUS

BACKGROUND OF THE INVENTION

1. Field of the Invention

The present invention relates to storm door latch mechanisms, and more particularly pertains to a new and improved storm door lock apparatus which may readily and efficiently enable latching of a storm door closure device in a predetermined orientation.

2. Description of the Prior Art

The use of storm door closure devices and cant locks for such devices is well known in the prior art. As may be appreciated, these devices are of a relatively small geometric configuration in relationship to a closure device and accordingly, access by a user in somewhat difficult when a user has limited access to the latch mechanism by preoccupation with articles being transported by the user.

In utilizing storm door locks of the prior art, a user must reposition articles that he may be transporting to enable latching of the door mechanism. For example, U.S. Pat. No. 2,920,338 to Falk is illustrative of a typical door closure with an associated cant lock 57 that must be grasped by a user's fingertips to enable actuation of the lock. This type of device is typical of the prior art in that access to the cant lock requires dexterity by a user when utilizing the lock during transport of articles by said user.

U.S. Pat. No. 3,566,435 to Nakanura sets forth a variation of a cant lock mechanism formed of a spiraled wire member that enables over-edge engagement with a cylinder of a pneumatic door closer, but sets forth the shortcomings of other prior art devices as noted.

U.S. Pat. No. 3,708,825 to Wood sets forth an elongate abutment member for checking the closing of a pneumatic-type door cylinder relying on gravity to cause a stop to fall into engagement with the end of the cylinder, wherein the stop mechanism of the Wood patent is awkward in usage and is further limiting in the positioning of the door closure, wherein the length of the abutment stop is the only position of checking the pneumatic arrangement available.

U.S. Pat. No. 4,194,264 to Stoffregen sets forth a relatively complex abutment door latch device wherein a lever is positioned along an associated rod of the piston and a cam and follower are actuatable from a preset position to tilt the lever into a locking engagement. The Stoffregen patent is of a complex and awkward configuration, as opposed to the instant invention.

U.S. Pat. No. 4,639,969 to Obenshain sets forth a pivotal detent lock engageable in a plurality of recesses of the door piston of the associated cylinder and is, as is other prior art, limiting in the positions available for securement of the piston rod relative to the piston.

As such, it may be appreciated that there is a continuing need for a new and improved storm door lock apparatus that addresses both the problem of effectiveness and ease of use, and in this respect the present invention substantially fulfills this need.

SUMMARY OF THE INVENTION

In view of the foregoing disadvantages inherent in the known types of storm door lock apparatuses now present in the prior art, the present invention provides a storm door lock apparatus wherein the same may be compactly and conveniently secured about a storm door pneumatic dampener cylinder and efficiently and effectively engageable with an associated piston rod of said cylinder to secure said piston rod by a pivotal cant lock arrangement relative to said cylinder. As such, the general purpose of the present invention, which will be described subsequently in greater detail, is to provide a new and improved storm door lock apparatus which has all the advantages of the prior art storm door lock apparatus and none of the disadvantages.

To attain this, the present invention comprises a storm door lock apparatus which may be compactly secured by a clamp member about a pneumatic cylinder of a storm door dampener with a projecting secondary clamp member overlying said clamp member to secure a rod slidably therethrough to actuate a pivotally positionable cant lock to secure a piston rod relative to said piston cylinder at a desired orientation.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is nether intended to define the invention of the application, which is measured by the claims, nor is it intended to be limiting as to the scope of the invention in any way.

It is therefore an object of the present invention to provide a new and improved storm door lock apparatus which has all the advantages of the prior art storm door lock apparatus and none of the disadvantages.

It is another object of the present invention to provide a new and improved storm door lock apparatus which may be easily and efficiently manufactured and marketed.

It is a further object of the present invention to provide a new and improved storm door lock apparatus which is of a durable and reliable construction.

An even further object of the present invention is to provide a new and improved storm door lock apparatus which is susceptible of a low cost of manufacture with regard to both materials and labor, and which accordingly is then susceptible of low prices of sale to the consuming public, thereby making such storm door lock apparatus economically available to the buying public.

Still yet another object of the present invention is to provide a new and improved storm door lock apparatus which provides in the apparatuses and methods of the prior art some of the advantages thereof, while simultaneously overcoming some of the disadvantages normally associated therewith.

Still another object of the present invention is to provide a new and improved storm door lock apparatus which may be efficiently and effectively actuated to secure a piston rod of a pneumatic cylinder defining a storm door dampener apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic view taken along the lines 4—4 of FIG. 3 in the direction indicated by the arrows.

DESCRIPTION OF THE PREFERRED EMBODIMENT

Figure 1:
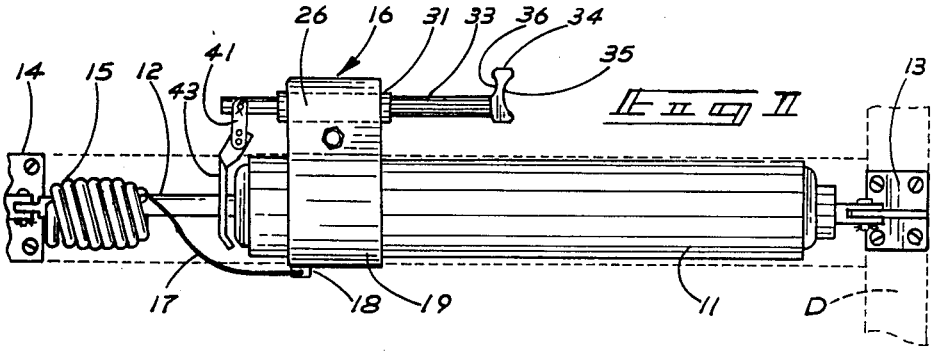
FIG. 1 is an orthographic view taken in elevation of the instant invention prior to actuation.
Figure 2:
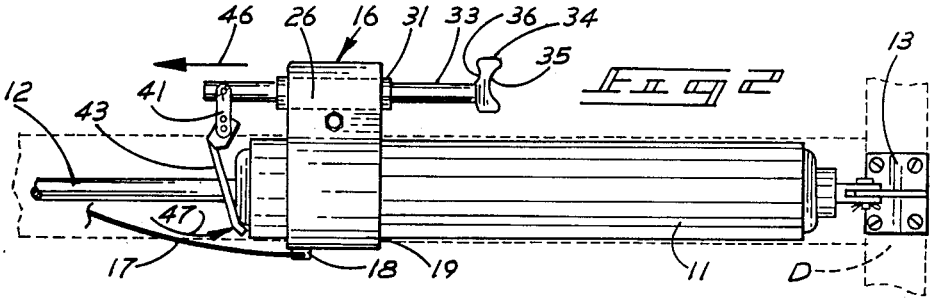
FIG. 2 is an orthographic view of the instant invention taken in elevation of the instant invention in an actuated mode.

With reference now to the drawings, and in particular to FIGS. 1 to 4 thereof, a new and improved storm door lock apparatus embodying the principles and concepts of the present invention and generally designated by the reference numeral 10 will be described.

More specifically, it will be noted that the storm door lock apparatus 10 essentially comprises a pneumatic or hydraulic-type dampener cylinder 11 at a reciprocating rod 12 therefrom with a cylinder bracket 13 and a cylinder rod bracket 14 to secure the respective cylinder rod and cylinder bracket to an associated door "D". A buffer spring 15 is secured at one end to the cylinder rod 12 and formed with a tether line 17 secured to a tether line "I" 18 which is integrally formed to the latch clamp 16 at a lowermost portion thereof, as illustrated.

Figure 3:
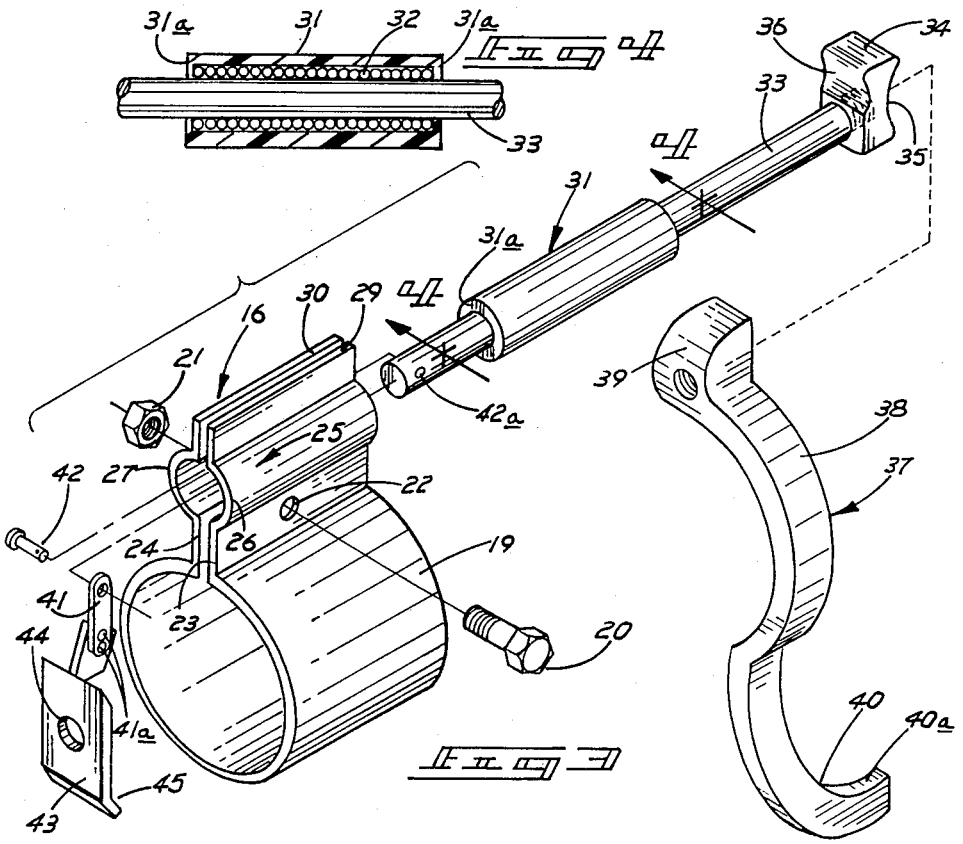
FIG. 3 is an isometric exploded view of the instant invention illustrating the various parts, their configuration, and relationship.

The latch clamp 16 is formed with reference to FIG. 3 with a discontinuous lower cylinder clamp portion 19 split at an upper portion thereof with a plurality of orthogonally and integrally formed flanges comprising a first flange 23 and a second flange 24. An opening 22 extends through the flanges 23 and 24 and accepts a bolt 20 therethrough to enable securement of the latch clamp 16 about the cylinder 11 by union of a nut 21 to the bolt 20. An upper cylindrical clamp is diametrically positioned overlying said lower cylindrical clamp portion and is formed as a split cylinder comprising a first semi-cylindrical portion 26 and a second semi-cylindrical 27 terminating with a first upper flange 29 and a second upper flange 30 respectively and integrally secured to the first and second semi-cylindrical portions 26 and 27.

The securement of the latch clamp 26 about the cylinder 11 within the lower discontinuous cylindrical clamp portion 19 forms a second upper cylindrical clamp 25 that secures a cylindrical bearing sleeve 31 therein wherein the sleeve 31 is formed with terminal end flanges 31a to capture a series of bearings 32 therebetween to slidingly accommodate the actuator rod 33 therethrough. The actuator rod 33 is accordingly axially parallel to the axis of the cylinder 11 and is formed at one terminal end with an abutment block 34 defining the first latching recess 35 facing away from the rod 33 and a second unlatching recess 36 facing in the direction of the actuator rod 33 whereby application of pressure by a user to the first recess 35 effects clamping of the cylindrical rod 12 and application of pressure to the second unlatching recess 36 releases the cylindrical rod 12 to enable reciprocation within the bearing sleeve 31.

Reference to FIG. 3 illustrates the inclusion of an accessory "L" shaped extension lever 37 formed with a central semi-circular convex portion 38 to accept the cylinder 11 slidingly therethrough and is formed with a companion upper boss 39 formed with an arcuate face for securement within the first latching recess 35. The extension lever 37 is formed with an actuation extension 40 terminating in a lip 40a that extends parallel to the rod 33 and orthogonally relative to the convex portion 38.

The extension lever 37 enables remote actuation of the door lock apparatus 10, such as when the apparatus is secured at an uppermost portion of a door frame or further, and provides a greater surface area of contact in lever actuation by a user.

The other end of the actuator rod 33 terminates on the other side of the bearing sleeve 31 and is formed with opening 42a therethrough to accept a lever pin 42 to secure a detent lever 41 pivotally thereto. The detent lever 41 is formed with a plurality of adjustment openings 41a at its other end for securement to the cant lever 43. The cant lever 43 is formed with a rod opening 44 to slidingly accept the cylinder rod 12 therethrough and terminates in a cant lever flange 45 remote from the securement of the cant lever 43 with the detent lever 41. In this manner, with reference to FIGS. 1 and 2, pressure applied to the latching recess 35 to slide the actuator rod 33 in the direction of arrow 46 pivots the cant lever 43 in the direction of arrow 47 to engage an end of the cylinder 11 and lock the cylinder in a desired orientation. When it is desired to unlatch the mechanism, pressure is merely applied to the unlatching recess 36.

As to the manner of usage and operation of the instant invention, the same should be apparent from the above disclosure and accordingly no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letter Patent of the United States is as follows:

1. A door latching mechanism for use in combination with a door including a fixed cylinder and an axially reciprocating piston rod comprising, a latch clamp means for securement to said cylinder including a first cylindrical clamp formed with a discontinuous interior clamping surface for direct contact about said cylinder, and a second cylindrical clamp integral with said first cylindrical and radially spaced parallel to said first clamp, and an actuator rod reciprocatably and slidably secured with said second clamp;

an abutment block secured to a first end of said actuator rod exteriorly of a first axial end of said second clamp, and a first end of a detent lever pivotally secured to the second end of said actuator rod exteriorly of the second axial end of said second clamp, and said detent lever including a second end pivotally secured to a cant lock, said cant lock including a central opening slidably accepting said piston rod therethrough, said detent lever positioned adjacent an end of said cylinder to tilt said cant lock in abutment with said cylinder to latch said cylinder relative to said piston rod when said actuator rod is slid in a first direction parallel to said cylinder and to tilt and unlatch said cant lock when said actuator rod is reciprocated in a second direction.

2. A door latching mechanism as set forth in claim 1 wherein said abutment block includes a first arcuate surface formed in a first face of said abutment block and a second arcuate surface formed in a second face of said abutment block parallel to said first face to accept and direct an application of force from a user to direct said actuator rod in said first and second directions.

3. A door latching mechanism as set forth in claim 2 wherein said second clamp is of a lesser diameter than said first clamp.

4. A door latching mechanism as set forth in claim 3 wherein said second clamp comprises two semi-circular surfaces securable together to form said second clamp.

5. A door latching mechanism as set forth in claim 4 wherein a cylindrical bearing sleeve is of an external diameter complementary to an interior diameter of said second clamp wherein said bearing sleeve incloses a plurality of bearing members to slidingly accept said actuator rod therethrough.

6. A door latching mechanism as set forth in claim 5 wherein said first clamp includes a tether eye integrally formed to an exterior surface of said first clamp diametrically opposed to said second clamp wherein said tether eye accepts a tether line and said tether line is secured between said tether eye and a buffer spring wherein said buffer spring is secured about said piston rod.

7. A door latching mechanism as set forth in claim 6 wherein said second end of said detent lever includes a plurality of openings to adjustably and pivotally accept said cant lock therethrough.

* * * * *